US009617609B2

(12) United States Patent
Nakagawa et al.

(10) Patent No.: US 9,617,609 B2
(45) Date of Patent: Apr. 11, 2017

(54) METHOD FOR PREPARING BLAST FURNACE BLOW-IN COAL

(71) Applicant: MITSUBISHI HEAVY INDUSTRIES, LTD., Tokyo (JP)

(72) Inventors: Keiichi Nakagawa, Tokyo (JP); Setsuo Omoto, Tokyo (JP); Masakazu Sakaguchi, Tokyo (JP); Tsutomu Hamada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 97 days.

(21) Appl. No.: 14/412,914

(22) PCT Filed: Sep. 19, 2013

(86) PCT No.: PCT/JP2013/075229
§ 371 (c)(1),
(2) Date: Jan. 5, 2015

(87) PCT Pub. No.: WO2014/057778
PCT Pub. Date: Apr. 17, 2014

(65) Prior Publication Data

US 2015/0203930 A1 Jul. 23, 2015

(30) Foreign Application Priority Data

Oct. 9, 2012 (JP) ..... 2012-224038

(51) Int. Cl.
*C21B 5/00* (2006.01)
*C21B 7/16* (2006.01)
*C21B 7/00* (2006.01)

(52) U.S. Cl.
CPC ..... *C21B 5/007* (2013.01); *C21B 5/003* (2013.01); *C21B 5/008* (2013.01); *C21B 7/00* (2013.01); *C21B 7/16* (2013.01)

(58) Field of Classification Search
CPC ..... C21B 5/008; C21B 7/16; C21B 7/00
See application file for complete search history.

(56) References Cited

U.S. PATENT DOCUMENTS 4,428,769 A * 1/1984 Limpach ..... C21B 5/003 75/460

FOREIGN PATENT DOCUMENTS

CN 101451070 A * 6/2009
CN 101638600 A * 2/2010
(Continued)

OTHER PUBLICATIONS

Jiang, S et al. CN 103060054 A published Apr. 2013. Machine translation.*
(Continued)

*Primary Examiner* — George Wyszomierski
*Assistant Examiner* — Tima M McGuthry Banks
(74) *Attorney, Agent, or Firm* — Westerman, Hattori, Daniels & Adrian, LLP

(57) ABSTRACT

On the basis of data obtained by means of analyzing coal, a first and second coal type satisfying conditions are selected, the ash melting point of the mixed coal resulting from mixing the first and second coal types is derived on the basis of a four-dimensional state diagram for $SiO_2$—CaO—MgO-20% $Al_2O_3$, on the basis of the ash melting point of the mixed coal and the four-dimensional state diagram, an additive causing the ash melting point of the mixed coal to be at least 1400° C. at the lowest quantity when added to the mixed coal is selected from $SiO_2$, MgO, and CaO, the addition quantity of the additive is derived, the first coal type and second coal type are mixed to result in the mixed coal, and the addition quantity of the additive is added to the mixed coal.

2 Claims, 5 Drawing Sheets

(56) References Cited

FOREIGN PATENT DOCUMENTS

| | | | | |
|---|---|---|---|---|
| CN | 103060054 | A | * | 4/2013 |
| JP | 57-79103 | A | | 5/1982 |
| JP | 3-291313 | A | | 12/1991 |
| JP | 5-156330 | A | | 6/1993 |
| JP | 2001-294911 | A | | 10/2001 |
| JP | 2001-323307 | A | | 11/2001 |
| JP | 2005-68474 | A | | 3/2005 |

OTHER PUBLICATIONS

Jiali, Liu et al. CN 101638600 A published Feb. 2010. Machine translation.*

Shizhuang, Shi et al. CN 101451070 A published Jun. 2009. Machine translation.*

International Search Report dated Oct. 22, 2013, issued in counterpart application No. PCT/JP2013/075229, with Forms PCT/IB1338, PCT/IB/373, PCT/ISA/237, and PCT/ISA/220 with English translation (16 pages).

* cited by examiner

METHOD FOR PREPARING BLAST FURNACE BLOW-IN COAL

TECHNICAL FIELD

The present invention relates to a method for preparing blast furnace blow-in coal.

BACKGROUND ART

Blast furnace installations have been configured so as to be capable of producing pig iron from iron ore by charging a starting material such as iron ore, limestone, or coke from the top of the blast furnace main body into the interior and blowing hot air and blast furnace blow-in coal (pulverized coal) as auxiliary fuel from a tuyere on the bottom side on the side of a blast furnace main body.

To stably operate the above blast furnace installation, the blast furnace blow-in coal must suppress accretion of blast furnace blow-in ash or blockage by that blast furnace blow-in ash in a pathway leading to the tuyere of the blast furnace main body.

For example, it has been proposed to improve combustibility of blast furnace blow-in coal by adding a CaO-based flux such as limestone or serpentinite to pulverized coal of which the softening point of the pulverized coal ash is less than 1300° C., thereby adjusting the softening point of the ash in the pulverized coal to not less than 1300° C., and then blowing only the pulverized coal of which the softening point of the pulverized coal ash is not less than 1300° C. into the interior from a tuyere of a blast furnace main body (for example, refer to Patent Document 1 below).

Furthermore, a blast furnace operating method has been proposed, wherein, for example, any one or two or more types of CaO-based, MgO-based and $SiO_2$-based flux are blown into the interior of a blast furnace from a tuyere (for example, refer to Patent Document 2 below).

CITATION LIST

Patent Literatures

Patent Document 1: Japanese Unexamined Patent Application Publication No. H05-156330A Patent Document 2: Japanese Unexamined Patent Application Publication No. H03-029131A

SUMMARY OF INVENTION

Technical Problem

However, with the powdered coal (blast furnace blow-in coal) described in Patent Document 1, although the ash softening point can be adjusted to not less than 1300° C. by adding flux together with a single pulverized coal or mixed pulverized coal when blowing, the flux is only calcium oxide, and as a result, the addition quantity of the flux becomes extremely large depending on the ash composition of the single pulverized coal(s), and there is the possibility of causing a decrease in the amount of heat generation of the blast furnace blow-in coal depending on the addition quantity thereof.

Additionally, in Patent Document 1, when the mixed pulverized coal is constituted of a coal having a high weight ratio of $SiO_2$ in the ash, for example, an $SiO_2$ content in the ash of not less than 70% by weight, and a low-ash-melting-point coal having a high weight ratio of CaO in the ash, for example, an $SiO_2$ content in the ash of not less than 35% by weight and not greater than 45% by weight, there is the possibility that the ash melting point of the obtained pulverized coal (blast furnace blow-in coal) cannot be increased and accretion of blast furnace blow-in ash or blockage by the blast furnace blow-in ash in a pathway leading to the tuyere of the blast furnace main body cannot be suppressed even if the compounding ratio of these coals is adjusted and calcium oxide flux is added to the mixed pulverized coal.

In Patent Document 2, described only is a blast furnace operating method which assures fluidity of bosh slag produced in the blast furnace by setting the viscosity at 1450° C. to not greater than 10 poise. Therefore, there is the possibility that accretion of blast furnace blow-in ash or blockage by the blast furnace blow-in ash in a pathway leading to the tuyere of the blast furnace main body cannot be suppressed.

From such facts, the present invention was devised to solve the problems described above, and an object of the present invention is to provide a method for preparing blast furnace blow-in coal that can provide blast furnace blow-in coal that suppresses accretion of blast furnace blow-in ash or blockage by the blast furnace blow-in ash in a pathway leading to a tuyere of a blast furnace main body while suppressing a decrease in the amount of heat generation despite containing low-ash-melting-point coal.

Solution to Problem

A method for preparing blast furnace blow-in coal pertaining to a first invention that solves the problems described above is a method for preparing blast furnace blow-in coal blown from a tuyere into the interior of a blast furnace main body of a blast furnace installation. The method comprising: a first step of analyzing the moisture content of run-of-mine coal, the ash of the coal, and the weight percentages of Al, Si, Ca and Mg in the ash; a second step of selecting, on the basis of data obtained by analysis, a first coal type, of which the moisture content of the run-of-mine coal is less than 15% by weight, and the total weight of Al, Si, Ca and Mg oxides in the ash is not less than 70% by weight of the ash weight, and, when the total of Al, Si, Ca and Mg oxides in the ash is taken as 100% by weight, an $Al_2O_3$ content is 20% by weight±5% by weight, and an $SiO_2$ content is not less than 70% by weight; a third step of selecting, on the basis of data obtained by analysis, a second coal type, of which the moisture content of the run-of-mine coal is not less than 15% by weight, and the total weight of Al, Si, Ca and Mg oxides in the ash is not less than 70% by weight of the ash weight, and, when the total of Al, Si, Ca and Mg oxides in the ash is taken as 100% by weight, the $Al_2O_3$ content is 20% by weight±5% by weight, and the $SiO_2$ content is not less than 35% by weight and not greater than 45% by weight, and an MgO content is not less than 0% by weight and not greater than 25% by weight; a fourth step of deriving an ash melting point of a mixed coal obtained by mixing the selected first coal type and the second coal type, on the basis of a four-dimensional state diagram for $SiO_2$—CaO—MgO-20% $Al_2O_3$ when the total of Al, Si, Ca and Mg oxides in the ash of the mixed coal is taken as 100% by weight and the $Al_2O_3$ content is converted to 20% by weight; a fifth step of selecting $SiO_2$, MgO or CaO as an additive to cause the ash melting point of the mixed coal to be not less than 1400° C. when added to the mixed coal in the smallest quantity, on the basis of the ash melting point of the mixed coal and the four-dimensional state diagram for $SiO_2$—CaO—MgO-20% $Al_2O_3$; a sixth step of deriving an addition quantity of the selected additive to the mixed coal; a seventh step of mixing the selected first coal type and the second coal type to result in mixed coal; and an eighth step of adding the additive in the addition quantity to the mixed coal.

A method for preparing blast furnace blow-in coal pertaining to a second invention that solves the problems described above is the method for preparing blast furnace blow-in coal pertaining to the first invention described above, wherein, in the fifth step, the CaO is selected as the additive upon the ash melting point of the mixed coal being within a region that is not greater than 1400° C. in the four-dimensional state diagram for $SiO_2$—CaO—MgO-20% $Al_2O_3$ when the total of Al, Si, Ca and Mg oxides in the ash of the mixed coal is taken as 100% by weight and the $Al_2O_3$ content is converted to 20% by weight, and being below a first boundary line according to equation (1), which represents the relationship between a content x of the $SiO_2$ and a content y of the CaO; the $SiO_2$ is selected as the additive upon the ash melting point of the mixed coal being within a region that is not greater than 1400° C. in the four-dimensional state diagram for $SiO_2$—CaO—MgO-20% $Al_2O_3$, and being above a second boundary line according to equation (2), which represents the relationship between the $SiO_2$ content x and the CaO content y; and the MgO is selected as the additive upon the ash melting point of the mixed coal being within a region that is not greater than 1400° C. in the four-dimensional state diagram for $SiO_2$—CaO—MgO-20% $Al_2O_3$, and being above the first boundary line and below the second boundary line.

$$y=0.083x^2-6.67x+166.3 \quad (1)$$

$$y=0.065x^2-6.86x+177.4 \quad (2)$$

Advantageous Effects of Invention

By the method for preparing blast furnace blow-in coal pertaining to the present invention, it is possible to obtain blast furnace blow-in coal that suppresses accretion of blast furnace blow-in ash or blockage by blast furnace blow-in ash in a pathway leading to a tuyere of a blast furnace main body while suppressing a decrease in the amount of heat generation despite containing low-ash-melting-point coal.

DESCRIPTION OF EMBODIMENTS

Embodiments of the method for preparing blast furnace blow-in coal pertaining to the present invention will be described based on the drawings, but the present invention is not limited only to the following embodiments described based on the drawings.

First Embodiment

A first embodiment of the method for preparing blast furnace blow-in coal pertaining to the present invention will be described based on FIGS. 1 and 2.

Figure 1:
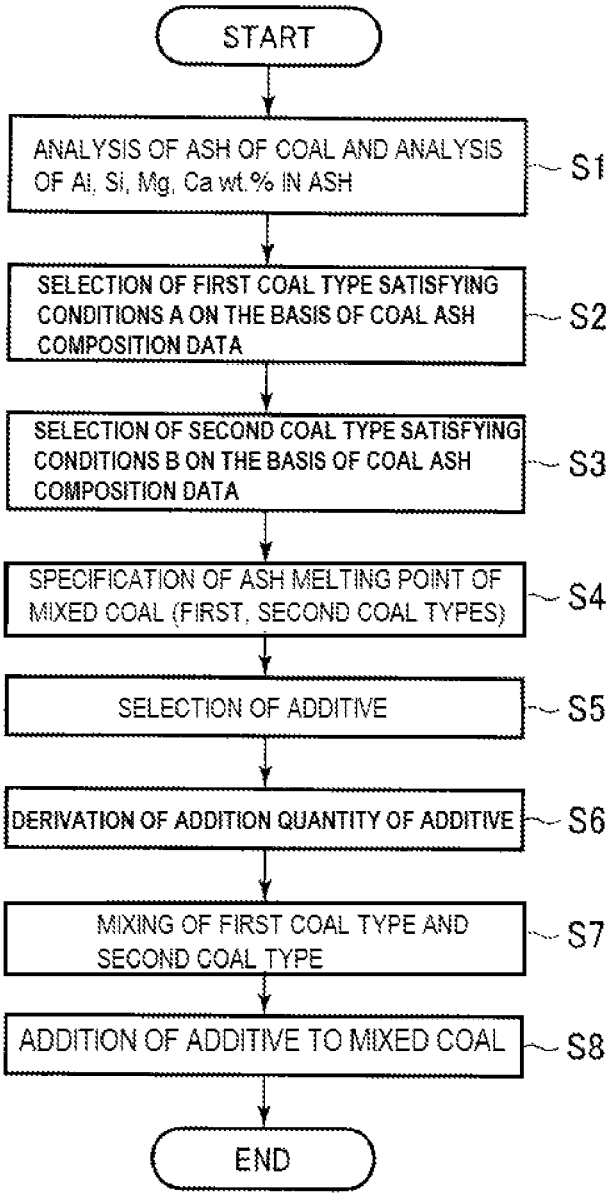
FIG. 1 is a flowchart illustrating a procedure of a method for preparing blast furnace blow-in coal pertaining to a first embodiment of the present invention.

The blast furnace blow-in coal pertaining to this embodiment is blast furnace blow-in coal blown from a tuyere into the interior of a blast furnace main body of a blast furnace installation, which, as illustrated in FIG. 1, can be easily prepared by analyzing the moisture content of run-of-mine coal, the ash of the coal, and the weight percentages of Al, Si, Ca and Mg in the ash of the coal (first step S1); selecting a first coal type satisfying conditions A (second step S2); selecting a second coal type with a low ash melting point satisfying conditions B different from conditions A (third step S3); deriving the ash melting point of the mixed coal obtained by mixing these coals (first coal type and second coal type) (fourth step S4); selecting an additive on the basis of the ash melting point of the mixed coal and a four-dimensional state diagram for $SiO_2$—CaO—MgO-20% $Al_2O_3$ (fifth step S5); deriving an addition quantity of the selected additive (sixth step S6); mixing the selected first coal type and the second coal type to result in mixed coal (seventh step S7); and adding the additive in the addition quantity to the mixed coal (eighth step S8).

In the first step S1, the moisture content of run-of-mine coal and the composition of the ash of the coal are the data most basically used as the quality of coal (run-of-mine coal), and are obtained by, for example, the industrial analysis set forth in JIS M 8812 (2004) implemented when the run-of-mine coal is produced or used.

In the first step S1, the weight percentages of Al, Si, Ma and Ca in the ash of the coal are the data most basically used as the quality of coal (run-of-mine coal), and are obtained by, for example, the analysis method of metal in exhaust gas set forth in JIS K 0083 (method by ICP (high-frequency inductively coupled plasma)) or the analysis method of coal ash and coke ash set forth in JIS M 8815 implemented when the run-of-mine coal is produced or used.

Figure 2:
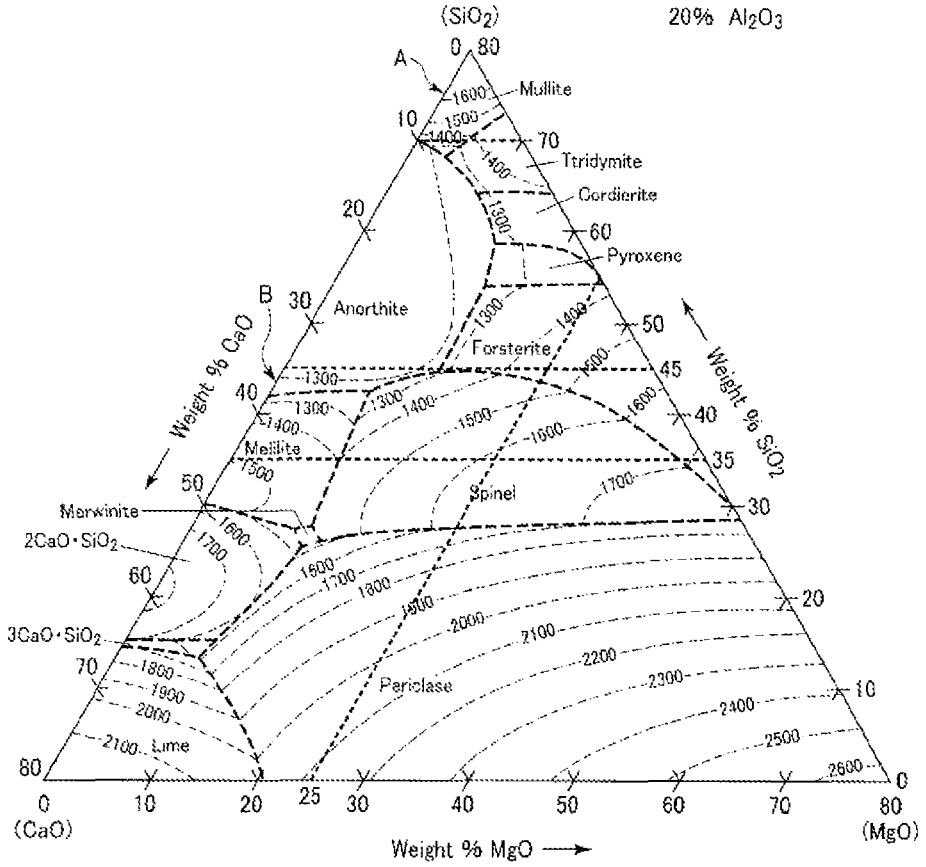
FIG. 2 is a four-dimensional state diagram for $SiO_2$—CaO—MgO-20% $Al_2O_3$ for the ash of the blast furnace blow-in coal pertaining to the first embodiment of the present invention.

Conditions A in the second step S2 are that the moisture content of the run-of-mine coal is less than 15% by weight, and the total weight of Al, Si, Ca and Mg oxides in the ash is not less than 70% by weight of the ash weight, and, as illustrated in FIG. 2, when the total of Al, Si, Ca and Mg oxides in the ash is taken as 100% by weight, the $Al_2O_3$ content is 20% by weight±5% by weight, and the $SiO_2$ content is not less than 70% by weight.

Conditions B in the third step S3 are that the moisture content of the run-of-mine coal is not less than 15% by weight, and the total weight of Al, Si, Ca and Mg oxides in the ash is not less than 70% by weight of the ash weight, and, as illustrated in FIG. 2, when the total of Al, Si, Ca and Mg oxides in the ash is taken as 100% by weight, the $Al_2O_3$ content is 20% by weight±5% by weight, and the $SiO_2$ content is not less than 35% by weight and not greater than 45% by weight, and the MgO content is not less than 0% by weight and not greater than 25% by weight.

Examples of run-of-mine coal of the second coal type satisfying conditions B are generally low-grade coals (oxygen atom content (dry base): more than 18% by weight; average pore diameter: from 3 to 4 nm) having a low ash melting point (for example, 1200° C.), such as lignite, sub-bituminous coal, bituminous coal and the like. Other coals that may be used include dry-distilled coals, specifically those having an oxygen atom content (dry base) of from 10 to 18% by weight, which has been greatly reduced by desorption of tar-producing groups such as oxygen-containing functional groups (carboxyl groups, aldehyde groups, ester groups, hydroxyl groups and the like), specifically those in which decomposition (reduction) of the main skeleton (combustion components of mainly C, H, O) has been greatly suppressed, and having an average pore diameter of from 10 to 50 nm by means of removing moisture by heating (from 110 to 200° C. for from 0.5 to 1 hour) low-grade coal in a low-oxygen atmosphere (oxygen concentration: not greater than 5% by volume) to dry it, and then removing water, carbon dioxide, tar and the like as dry-distilled gas or dry-distilled oil by dry distillation while heating (from 460 to 590° C. (preferably from 500 to 550° C.) for from 0.5 to 1 hour) in a low-oxygen atmosphere (oxygen concentration: not greater than 2% by volume), and then cooling (not higher than 50° C.) in a low-oxygen atmosphere (oxygen concentration: not greater than 2% by volume).

In the fourth step S4, the weight ratio of $SiO_2$, CaO and MgO in the ash of the mixed coal is determined on the basis of the ash composition data of the first coal type obtained in the first step S1, the ash composition data of the second coal type obtained in the first step S1, and the mixing proportion of the first coal type and the second coal type, by taking the total of Al, Si, Ca and Mg oxides in the ash of the mixed coal as 100% by weight and converting the $Al_2O_3$ content in the ash of the mixed coal to 20% by weight. On the basis of the weight ratio of $SiO_2$, CaO and MgO in the ash of the mixed coal and a four-dimensional state diagram for $SiO_2$—CaO—MgO-20% $Al_2O_3$ illustrated in FIG. 2, the ash melting point of the mixed coal is derived. The mixing proportion of the first coal type and the second coal type may be set as appropriate; for example, it is advantageous when the second coal type is not less than 25% by weight.

In the fifth step S5, on the basis of the ash melting point of the mixed coal derived in the fourth step S4 and the four-dimensional state diagram for $SiO_2$—CaO—MgO-20% $Al_2O_3$ illustrated in FIG. 2, one type of $SiO_2$, MgO or CaO is selected as an additive to cause the ash melting point of the mixed coal to be not less than 1400° C., which is higher than the hot air (1200° C.) blown into the interior from the tuyere on the bottom side on the side of the blast furnace main body of the blast furnace installation, when added to the mixed coal in the smallest quantity (addition quantity). Examples of $SiO_2$ sources include silica stone, clay and the like. Examples of MgO sources include MgO powder, natural minerals, dolomite, magnesium carbonate and the like. Examples of CaO sources include quicklime, limestone, serpentinite and the like.

In the sixth step S6, the addition quantity of the additive to the mixed coal is derived on the basis of the ash melting point of the mixed coal derived in the fourth step S4, the four-dimensional state diagram for $SiO_2$—CaO—MgO-20% $Al_2O_3$ illustrated in FIG. 2, and the additive selected in the fifth step S5.

In the eighth step S8, blast furnace blow-in coal is prepared by adding the additive selected in the fifth step S5 to the mixed coal in the addition quantity derived in the sixth step S6.

Because the blast furnace blow-in coal produced by the method for preparing blast furnace blow-in coal pertaining to this embodiment is a mixed coal of the first coal type satisfying conditions A and the second coal type satisfying conditions B, and because the additive selected on the basis of the ash melting point of the mixed coal and a four-dimensional state diagram for $SiO_2$—CaO—MgO-20% $Al_2O_3$ has been added in the addition quantity to the mixed coal, the ash melting point of the blast furnace blow-in coal is from 100 to 150° C. higher than the temperature of the hot air blown into the interior from the tuyere of the blast furnace main body, and the ash of blast furnace blow-in coal (blast furnace blow-in ash) does not melt by the hot air and as a result, it can suppress accretion of blast furnace blow-in ash or blockage by the blast furnace blow-in ash in the pathway leading to the tuyere of the blast furnace main body.

For this reason, with the blast furnace blow-in coal pertaining to this embodiment, because the additive is selected from $SiO_2$, MgO or CaO and the addition quantity of the selected additive is derived, the addition quantity of the additive can be reduced even though the ash melting point of the mixed coal obtained by mixing the first coal type and the second coal type is lowered to less than 1400° C., unlike the case where only calcium oxide can be selected as an additive. As a result, a decrease in the amount of heat generation of the obtained blast furnace blow-in coal can be suppressed.

Therefore, by the method for preparing blast furnace blow-in coal pertaining to this embodiment, it is possible to obtain blast furnace blow-in coal that suppresses accretion of blast furnace blow-in ash or blockage by blast furnace blow-in ash in a pathway leading to a tuyere of a blast furnace main body while suppressing a decrease in the amount of heat generation despite containing low-ash-melting-point coal.

Additionally, because one type of $SiO_2$, CaO or MgO can be selected as the additive, unlike conventional pulverized coal (blast furnace blow-in coal) obtained by adding calcium oxide as flux together with single pulverized coal or mixed pulverized coal, the ash melting point of the blast furnace blow-in coal obtained by adding the additive to a mixed coal of the first coal type and the second coal type can be increased to not less than 1400° C., despite containing a first coal type of which the $SiO_2$ content in the ash is not less than 70% by weight and a low-ash-melting-point second coal type of which the $SiO_2$ content in the ash is not less than 35% by weight and not greater than 45% by weight.

Second Embodiment

A second embodiment of the method for preparing blast furnace blow-in coal pertaining to the present invention will be described based on FIG. 1 and FIGS. 3 to 5.

This embodiment employs a procedure illustrated in FIG. 1 in which the fifth step S5 of the first embodiment has been modified. The other steps are roughly the same as those illustrated in FIG. 1, and duplicate descriptions will be omitted as appropriate.

Figure 3:
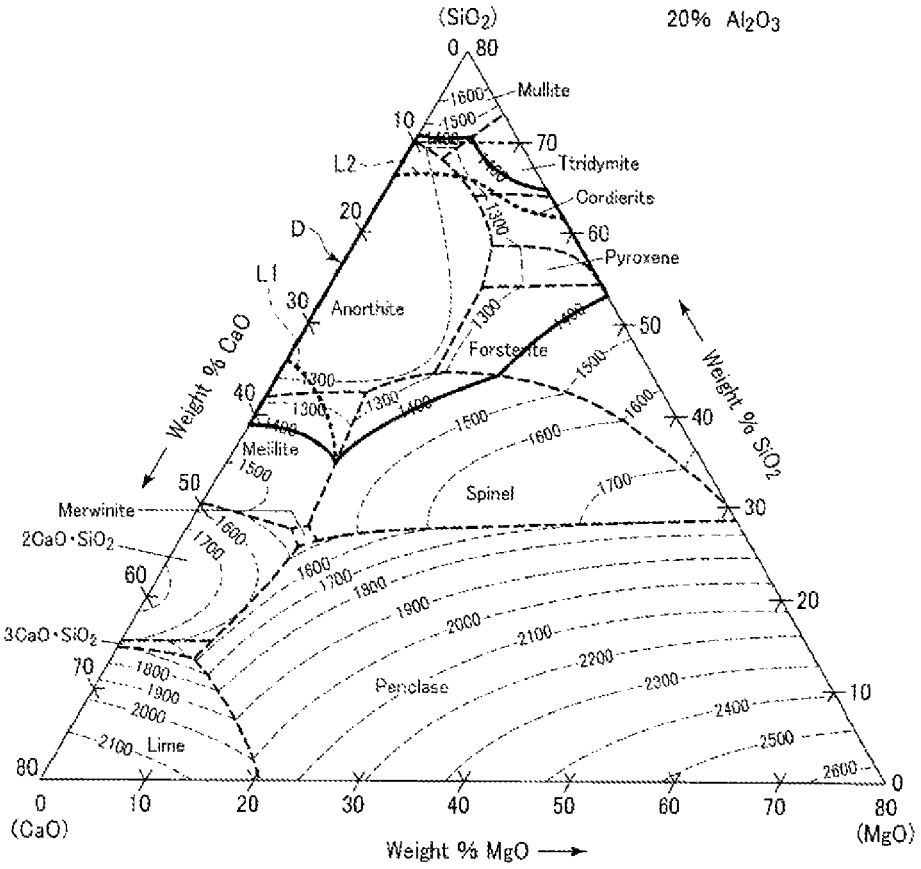
FIG. 3 is a four-dimensional state diagram for $SiO_2$—CaO—MgO-20% $Al_2O_3$ for the ash of the blast furnace blow-in coal pertaining to a second embodiment of the present invention.

In this embodiment, in the fifth step S5 of selecting the additive added to the mixed coal, first, it is specified where the ash melting point of the mixed coal derived in the fourth step S4 performed prior to the fifth step S5 is positioned in the four-dimensional state diagram for $SiO_2$—CaO—MgO-20% $Al_2O_3$ when the total of Al, Si, Ca and Mg oxides in the ash of the coal is taken as 100% by weight and the $Al_2O_3$ content is converted to 20% by weight, illustrated in FIG. 3. In short, it is specified where the ash melting point of the mixed coal is positioned in region D encompassed by the solid line in FIG. 3, which is the region in which the ash melting point of coal is not greater than 1400° C. Furthermore, if the ash melting point of the mixed coal is positioned outside region D, the mixed coal can be used as blast furnace blow-in coal without adding the additive to the mixed coal because the ash melting point of that mixed coal is higher than 1400° C.

Next, a first boundary line L1 which results in the smallest addition quantity of the additive is derived by selecting CaO or MgO as the additive on the basis of the four-dimensional state diagram for $SiO_2$—CaO—MgO-20% $Al_2O_3$ illustrated in FIG. 3.

Figure 4:
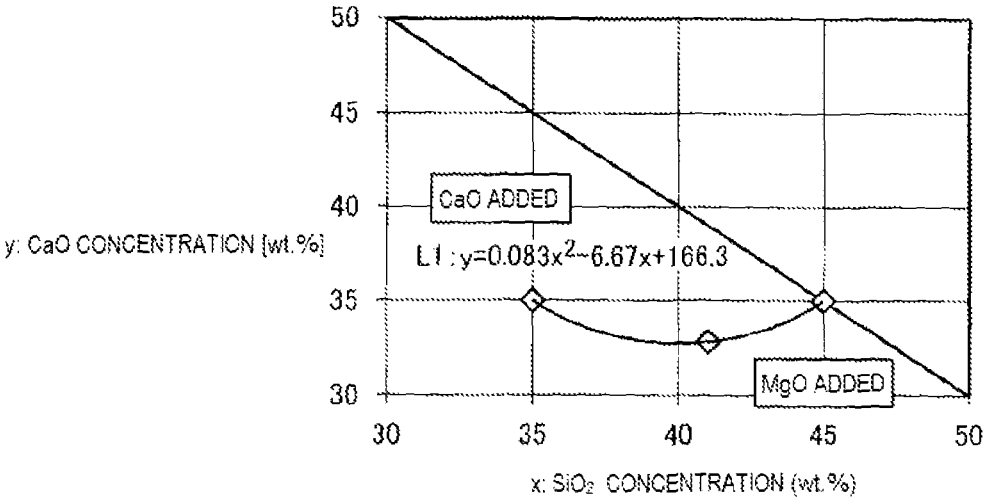
FIG. 4 is a diagram used for deriving a first boundary line in FIG. 3.

The first boundary line L1, as illustrated in FIGS. 3 and 4, is a curve that satisfies, for example, equation (1) representing the relationship between $SiO_2$ content x and CaO content y, which passes through the location where the $SiO_2$ content is 35% by weight and the CaO content is 35% by weight, and the location where the $SiO_2$ content is 41% by weight and the CaO content is 33% by weight, and the location where the $SiO_2$ content is 45% by weight and the CaO content is 35% by weight, when the total of Al, Si, Ca and Mg oxides in the ash of the coal is taken as 100% by weight.

$$y=0.083x^2-6.67x+166.3 \quad (1)$$

A second boundary line L2 which results in the smallest addition quantity of the additive is derived by selecting $SiO_2$ or MgO as the additive on the basis of the four-dimensional state diagram for $SiO_2$—CaO—MgO-20% $Al_2O_3$ illustrated in FIG. 3.

Figure 5:
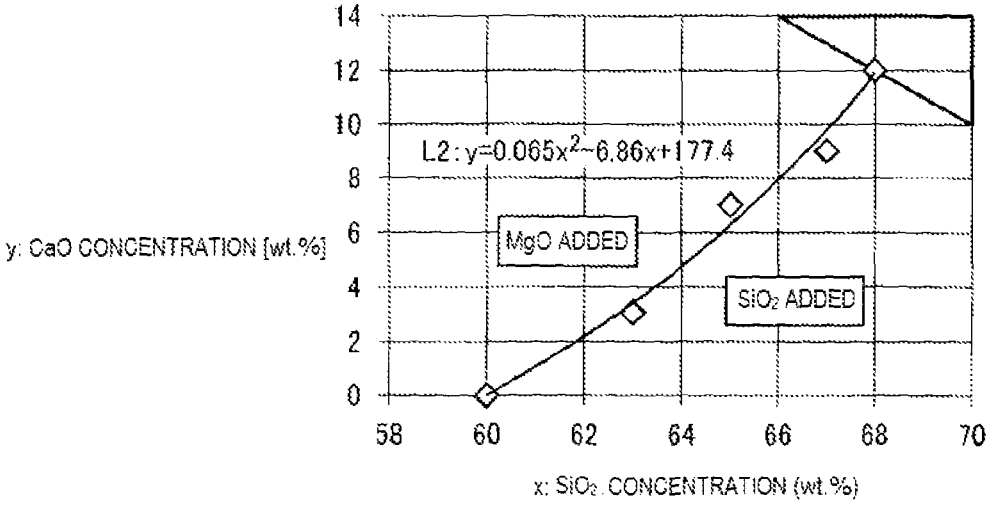
FIG. 5 is a diagram used for deriving a second boundary line in FIG. 3.

The second boundary line L2, as illustrated in FIGS. 3 and 5, is a curve that satisfies, for example, equation (2) representing the relationship between $SiO_2$ content x and CaO content y, which passes through the location where the $SiO_2$ content is 60% by weight and the CaO content is 0% by weight, and near the location where the $SiO_2$ content is 63% by weight and the CaO content is 3% by weight, and near the location where the $SiO_2$ content is 65% by weight and the CaO content is 7% by weight, and near the location where the $SiO_2$ content is 67% by weight and the CaO content is 9% by weight, and near the location where the $SiO_2$ content is 68% by weight and the CaO content is 12% by weight, when the total of Al, Si, Ca and Mg oxides in the ash of the coal is taken as 100% by weight.

$$y=0.065x^2-6.86x+177.4 \quad (2)$$

In short, in the fifth step S5, the CaO is selected as the additive upon the ash melting point of the mixed coal being within region D, which is not greater than 1400° C. in the four-dimensional state diagram for $SiO_2$—CaO—MgO-20% $Al_2O_3$ when the total of Al, Si, Ca and Mg oxides in the ash of the mixed coal is taken as 100% and the $Al_2O_3$ content is converted to 20% by weight, illustrated in FIG. 3, and being below the first boundary line L1 according to equation (1). As a result, it is possible to cause the ash melting point of the blast furnace blow-in coal obtained by adding CaO as the additive to the mixed coal to be not less than 1400° C., despite the CaO addition quantity being lower than in cases where another additive such as $Si_2O$ or MgO is added.

In the fifth step S5, the $SiO_2$ is selected as the additive upon the ash melting point of the mixed coal being within region D, which is not greater than 1400° C. in the four-dimensional state diagram for $SiO_2$—CaO—MgO-20% $Al_2O_3$ when the total of Al, Si, Ca and Mg oxides in the ash of the mixed coal is taken as 100% and the $Al_2O_3$ content is converted to 20% by weight, illustrated in FIG. 3, and being above a second boundary line L2 according to equation (2). As a result, it is possible to cause the ash melting point of the blast furnace blow-in coal obtained by adding $SiO_2$ as the additive to the mixed coal to be not less than 1400° C., despite the $SiO_2$ addition quantity being lower than in cases where another additive such as CaO or MgO is added.

In the fifth step S5, the MgO is selected as the additive upon the ash melting point of the mixed coal being within region D, which is not greater than 1400° C. in the four-dimensional state diagram for $SiO_2$—CaO—MgO-20% $Al_2O_3$ when the total of Al, Si, Ca and Mg oxides in the ash of the mixed coal is taken as 100% and the $Al_2O_3$ content is converted to 20% by weight, illustrated in FIG. 3, and being above the first boundary line L1 and below the second boundary line L2. As a result, it is possible to cause the ash melting point of the blast furnace blow-in coal obtained by adding MgO as the additive to the mixed coal to be not less than 1400° C., despite the MgO addition quantity being lower than in cases where another additive such as $SiO_2$ or CaO is added.

Thus, the position of the ash melting point of the mixed coal derived in the fourth step S4 in the four-dimensional state diagram for $SiO_2$—CaO—MgO-20% $Al_2O_3$ illustrated in FIG. 3 is derived, and on the basis of the position of the ash melting point of the mixed coal, the additive can be selected and the addition quantity of the additive can be derived, and as a result, the additive can be more reliably selected and the addition quantity of the additive can be more reliably derived.

Therefore, by the method for preparing blast furnace blow-in coal pertaining to this embodiment, it is possible to obtain blast furnace blow-in coal that suppresses accretion of blast furnace blow-in ash or blockage by blast furnace blow-in ash in a pathway leading to a tuyere of a blast furnace main body while suppressing a decrease in the amount of heat generation despite containing low-ash-melting-point coal, more reliably than in the embodiment described previously.

EXAMPLES

Working examples performed to confirm the operation and effect of the method for preparing blast furnace blow-in coal pertaining to the present invention will be described below, but the present invention is not limited to only the following working examples described based on various data.

First, as illustrated in FIG. 1, the moisture content of run-of-mine coal and the ash of the coal are analyzed, and the weight percentages of Al, Si, Ca and Mg in the ash of the coal are analyzed in advance (first step S1), a first coal type satisfying conditions A is selected (second step S2), and a second coal type satisfying conditions B different from conditions A is selected (third step S3). In this working example, coal type 1 shown in Table 1 below was selected as the first coal type satisfying conditions A, and coal type 2 shown in Table 1 below was selected as the second coal type satisfying conditions B.

TABLE 1

| | | Units | Coal type 1 | Coal type 2 |
|---|---|---|---|---|
| Ash composition | $SiO_2$ | wt. % | 31.7 | 70.3 |
| | $Al_2O_3$ | wt. % | 17.2 | 23.7 |
| | $TiO_2$ | wt. % | 1.34 | 1.14 |
| | $Fe_2O_3$ | wt. % | 5.98 | 4.47 |
| | CaO | wt. % | 22.9 | 0.6 |
| | MgO | wt. % | 5.11 | 0.6 |
| | $Na_2O$ | wt. % | 1.4 | 0.42 |
| | $K_2O$ | wt. % | 0.42 | 1.35 |

TABLE 1-continued

| | Units | Coal type 1 | Coal type 2 |
|---|---|---|---|
| $SO_3$ | wt. % | 9.36 | — |
| $P_2O_3$ | wt. % | 0.88 | — |
| Total of $SiO_2$, $Al_2O_3$, CaO and MgO | wt. % | 76.91 | 95.2 |
| $SiO_2$ (as converted when $SiO_2$, $Al_2O_3$, CaO and MgO total 100 wt. %) | wt. % | 41.2 | 73.8 |
| $Al_2O_3$ (as converted when $SiO_2$, $Al_2O_3$, CaO and MgO total 100 wt. %) | wt. % | 22.4 | 24.9 |
| CaO (as converted when $SiO_2$, $Al_2O_3$, CaO and MgO total 100 wt. %) | wt. % | 29.8 | 0.6 |
| MgO (as converted when $SiO_2$, $Al_2O_3$, CaO and MgO total 100 wt. %) | wt. % | 6.6 | 0.6 |
| $SiO_2$ (as converted when $SiO_2$, CaO and MgO total 80 wt. %) | wt. % | 42.47 | 78.72 |
| CaO (as converted when $SiO_2$, CaO and MgO total 80 wt. %) | wt. % | 30.72 | 0.64 |
| MgO (as converted when $SiO_2$, CaO and MgO total 80 wt. %) | wt. % | 6.8 | 0.64 |

Figure 6:
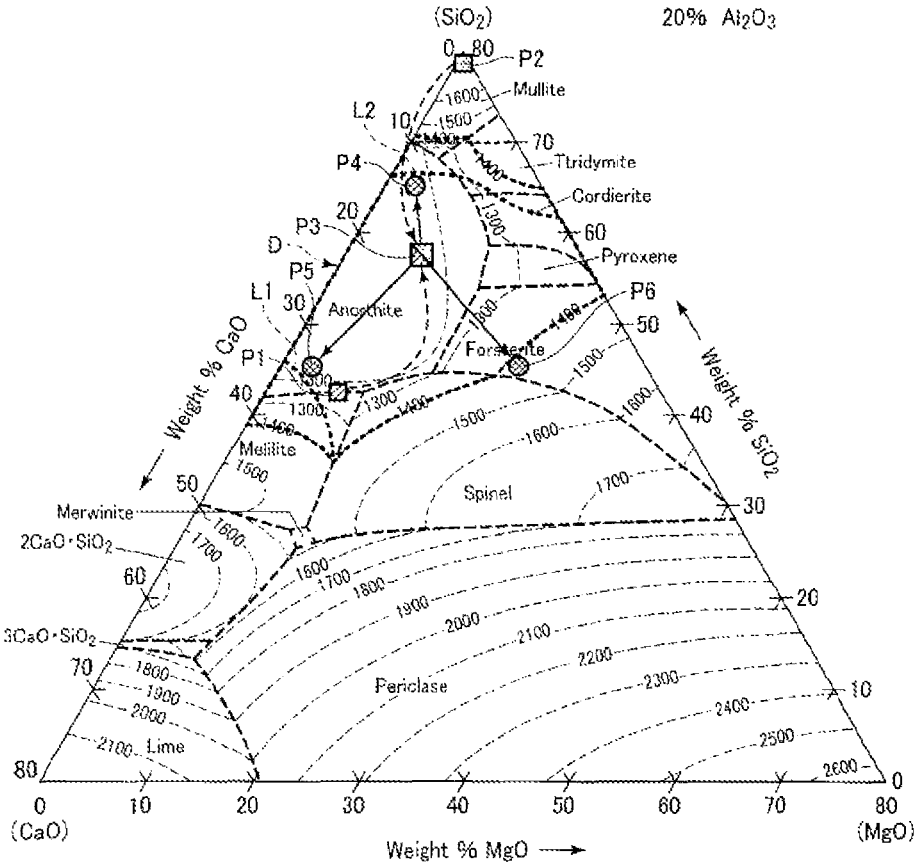
FIG. 6 is a four-dimensional state diagram for $SiO_2$—CaO—MgO-20% $Al_2O_3$ used for describing a confirmation test of the method for preparing blast furnace blow-in coal pertaining to the embodiments of the present invention.

When the total of Al, Si, Ca and Mg oxides in the ash of coal type 1 was taken as 100% by weight and the $Al_2O_3$ content was converted to 20% by weight, the contents of Si, Ca and Mg oxides in the ash of coal type 1 were the values shown in Table 1 above. Thus, the ash melting point of coal type 1 is positioned at point P1 in FIG. 6, which is a four-dimensional state diagram for $SiO_2$—CaO—MgO-20% $Al_2O_3$ when the total of Al, Si, Ca and Mg oxides in the ash of the coal is taken as 100% by weight and the $Al_2O_3$ content is converted to 20% by weight.

When the total of Al, Si, Ca and Mg oxides in the ash of coal type 2 was taken as 100% by weight and the $Al_2O_3$ content was converted to 20% by weight, the contents of Si, Ca and Mg oxides in the ash of coal type 2 were the values shown in Table 1 above. Thus, the ash melting point of coal type 2 is positioned at point P2 in FIG. 6.

Here, when the total of Al, Si, Ca and Mg oxides in the ash of the mixed coal was taken as 100% by weight and the $Al_2O_3$ content was converted to 20% by weight, the contents of Si, Ca and Mg oxides in the ash of the mixed coal obtained by mixing coal type 1 and coal type 2 were the values shown in Table 2 below. Thus, the ash melting point of the mixed coal is positioned at point P3 in FIG. 6. In short, the ash melting point of the mixed coal is positioned within region D, which is not greater than 1400° C.

TABLE 2

| | | Mixed coal (wt. %) |
|---|---|---|
| Ash composition | $SiO_2$ (as converted when $SiO_2$, $Al_2O_3$, CaO and MgO total 100 wt. %) | 57.5 |
| | $Al_2O_3$ (as converted when $SiO_2$, $Al_2O_3$, CaO and MgO total 100 wt. %) | 23.6 |
| | CaO (as converted when $SiO_2$, $Al_2O_3$, CaO and MgO total 100 wt. %) | 15.2 |
| | MgO (as converted when $SiO_2$, $Al_2O_3$, CaO and MgO total 100 wt. %) | 3.6 |
| | Total of $SiO_2$, $Al_2O_3$, CaO and MgO | 100.0 |
| | $SiO_2$ (as converted when $SiO_2$, CaO and MgO total 80 wt. %) | 60.3 |
| | CaO (as converted when $SiO_2$, CaO and MgO total 80 wt. %) | 15.9 |
| | MgO (as converted when $SiO_2$, CaO and MgO total 80 wt. %) | 3.8 |
| | Total of $SiO_2$, CaO and MgO | 80.0 |

Blast furnace blow-in coal obtained by selecting $SiO_2$ as an additive and adding 25% by weight $SiO_2$ to the above mixed coal even though the ash melting point P3 of the mixed coal is positioned at a location where MgO is to be selected as the additive in the method for preparing blast furnace blow-in coal pertaining to the second embodiment described above, was used as comparative substance 1. When the total of Al, Si, Ca and Mg oxides in the ash of comparative substance 1 was taken as 100% by weight and the $Al_2O_3$ content was converted to 20% by weight, the contents of Si, Ca and Mg oxides in the ash of comparative substance 1 were the values shown in Table 3 below. Thus, the ash melting point of comparative substance 1 is positioned at point P4 in FIG. 6, and it is clear that the ash melting point P4 of comparative substance 1 is positioned within region D, in which the ash melting point of coal is not greater than 1400° C.

Blast furnace blow-in coal obtained by selecting CaO as an additive and adding 25% by weight CaO to the above mixed coal was used as comparative substance 2. When the total of Al, Si, Ca and Mg oxides in the ash of comparative substance 2 was taken as 100% by weight and the $Al_2O_3$ content was converted to 20% by weight, the contents of Si, Ca and Mg oxides in the ash of comparative substance 2 were the values shown in Table 3 below. Thus, the ash melting point of comparative substance 2 is positioned at point P5 in FIG. 6, and it is clear that the ash melting point P5 of comparative substance 2 is positioned within region D, in which the ash melting point of coal is not greater than 1400° C.

Blast furnace blow-in coal obtained by selecting MgO as an additive and adding 25% by weight MgO to the above mixed coal because the ash melting point P3 of the mixed coal is positioned at a location where MgO is to be selected as the additive in the method for preparing blast furnace blow-in coal pertaining to the second embodiment described above, was used as test substance 1. When the total of Al, Si, Ca and Mg oxides in the ash of test substance 1 was taken as 100% by weight and the $Al_2O_3$ content was converted to 20% by weight, the contents of Si, Ca and Mg oxides in the ash of test substance 1 were the values shown in Table 3 below. Thus, the ash melting point of test substance 1 is positioned at point P6 in FIG. 6, and it is clear that the ash melting point P6 of test substance 1 is positioned in a region in which the ash melting point of coal is not greater than 1400° C.

TABLE 3

| | | Test substance 1 | Comparative substance 1 | Comparative substance 2 |
|---|---|---|---|---|
| Ash composition | $SiO_2$ (as converted when $SiO_2$, $Al_2O_3$, CaO and MgO total 100 wt. %) | 46.0 | 66.0 | 46.0 |

TABLE 3-continued

| | Test substance 1 | Comparative substance 1 | Comparative substance 2 |
|---|---|---|---|
| $Al_2O_3$ (as converted when $SiO_2$, $Al_2O_3$, CaO and MgO total 100 wt. %) | 18.9 | 18.9 | 18.9 |
| CaO (as converted when $SiO_2$, $Al_2O_3$, CaO and MgO total 100 wt. %) | 12.2 | 12.2 | 32.2 |
| MgO (as converted when $SiO_2$, $Al_2O_3$, CaO and MgO total 100 wt. %) | 22.9 | 2.9 | 2.9 |
| Total of $SiO_2$, $Al_2O_3$, CaO and MgO | 100.0 | 100.0 | 100.0 |
| $SiO_2$ (as converted when $SiO_2$, CaO and MgO total 80 wt. %) | 45.4 | 65.1 | 45.4 |
| CaO (as converted when $SiO_2$, CaO and MgO total 80 wt. %) | 12.0 | 12.0 | 31.7 |
| MgO (as converted when $SiO_2$, CaO and MgO total 80 wt. %) | 22.6 | 2.9 | 2.9 |
| Total of $SiO_2$, CaO and MgO | 80.0 | 80.0 | 80.0 |

Thus, it is clear that by this working example, it is possible to obtain blast furnace blow-in coal that suppresses accretion of blast furnace blow-in ash or blockage by blast furnace blow-in ash in a pathway leading to a tuyere of a blast furnace main body while suppressing a decrease in the amount of heat generation despite containing low-ash-melting-point coal, by analyzing the moisture content of run-of-mine coal, the ash of the coal, and the weight percentages of Al, Si, Ca and Mg in the ash of the coal; selecting a first coal type satisfying conditions A; selecting a second coal type satisfying conditions B different from conditions A; deriving the ash melting point of the mixed coal obtained by mixing these coals (first coal type and second coal type) on the basis of a four-dimensional state diagram for $SiO_2$—CaO—MgO-20% $Al_2O_3$ when the total of Al, Si, Ca and Mg oxides in the ash of the mixed coal is taken as 100% by weight and the $Al_2O_3$ content is converted to 20% by weight; selecting $SiO_2$, MgO or CaO as an additive to cause the ash melting point of the mixed coal to be not less than 1400° C. when added to the mixed coal in the smallest quantity on the basis of the ash melting point of the mixed coal and a four-dimensional state diagram for $SiO_2$—CaO—MgO-20% $Al_2O_3$; deriving an addition quantity of the additive; mixing the first coal type and the second coal type to result in mixed coal; and adding the additive in the addition quantity to the mixed coal.

Furthermore, a method for preparing blast furnace blow-in coal in which the third step S3 is performed after the second step S2 was described above, but a method for preparing blast furnace blow-in coal in which the second step S2 and the third step S3 are performed simultaneously, or a method for preparing blast furnace blow-in coal in which the second step S2 is performed after the third step S3, may also be used.

INDUSTRIAL APPLICABILITY

The method for preparing blast furnace blow-in coal pertaining to the present invention can be used extremely advantageously in the iron-making industry because it can provide blast furnace blow-in coal that suppresses accretion of blast furnace blow-in ash or blockage by blast furnace blow-in ash in a pathway leading to a tuyere of a blast furnace main body while suppressing a decrease in the amount of heat generation despite containing low-ash-melting-point coal.

REFERENCE SIGNS LIST

A Conditions of first coal type
B Conditions of second coal type
D Region of ash melting point of mixed coal not greater than 1400° C.
L1 First boundary line
L2 Second boundary line
P1 Ash melting point of coal type 1
P2 Ash melting point of coal type 2
P3 Ash melting point of mixed coal (coal types 1, 2)
P4 Ash melting point of comparative substance 1
P5 Ash melting point of comparative substance 2
P6 Ash melting point of test substance 1
S1 First step (analysis step)
S2 Second step (first coal type selection step)
S3 Third step (second coal type selection step)
S4 Fourth step (mixed coal ash melting point derivation step)
S5 Fifth step (additive selection step)
S6 Sixth step (addition quantity derivation step)
S7 Seventh step (mixing step)
S8 Eighth step (addition step)

The invention claimed is:

1. A method for preparing blast furnace blow-in coal blown from a tuyere into an interior of a blast furnace main body of a blast furnace installation, the method comprising:

a first step of analyzing a moisture content of run-of-mine coal, ash of the coal, and weight percentages of Al, Si, Ca and Mg in the ash;

a second step of selecting, on the basis of data obtained by analysis, a first coal type, of which the moisture content in the run-of-mine coal is less than 15% by weight, and a total weight of Al, Si, Ca and Mg oxides in the ash is not less than 70% by weight of the ash weight, and, when the total of Al, Si, Ca and Mg oxides in the ash is taken as 100% by weight, an $Al_2O_3$ content is 20% by weight ±5% by weight, and an $SiO_2$ content is not less than 70% by weight;

a third step of selecting, on the basis of data obtained by analysis, a second coal type, of which the moisture content in the run-of-mine coal is not less than 15% by weight, and the total weight of Al, Si, Ca and Mg oxides in the ash is not less than 70% by weight of the ash weight, and, when the total of Al, Si, Ca and Mg oxides in the ash is taken as 100% by weight, the $Al_2O_3$ content is 20% by weight ±5% by weight, and the $SiO_2$ content is not less than 35% by weight and not greater than 45% by weight, and an MgO content is not less than 0% by weight and not greater than 25% by weight;

a fourth step of deriving an ash melting point of a mixed coal upon mixing the selected first coal type and the second coal type, on the basis of a four-dimensional state diagram for $SiO_2$—CaO—MgO-20% $Al_2O_3$ when the total weight of Al, Si, Ca and Mg oxides in the ash of the mixed coal is taken as 100% by weight and the $Al_2O_3$ content is converted to 20% by weight;

a fifth step of selecting $SiO_2$, MgO or CaO as an additive to cause the ash melting point of the mixed coal upon mixing the selected first coal type and the second coal type to be not less than 1400° C. when added to the mixed coal in the smallest quantity, on the basis of the ash melting point of the mixed coal and the four-dimensional state diagram for $SiO_2$—CaO—MgO-20% $Al_2O_3$;

a sixth step of deriving an addition quantity of the selected additive to the mixed coal;

a seventh step of mixing the selected first coal type and the second coal type to result in mixed coal; and an eighth step of adding the additive in the addition quantity to the mixed coal.

2. The method for preparing blast furnace blow-in coal according to claim 1, wherein, in the fifth step, the CaO is selected as the additive upon the ash melting point of the mixed coal being within a region not greater than 1400° C. in the four-dimensional state diagram for $SiO_2$—CaO—MgO-20% $Al_2O_3$ when the total of Al, Si, Ca and Mg oxides in the ash of the mixed coal is taken as 100% by weight and the $Al_2O_3$ content is converted to 20% by weight, and being below a first boundary line according to equation (1) representing a relationship between a content x of the $SiO_2$ and a content y of the CaO;

the $SiO_2$ is selected as the additive upon the ash melting point of the mixed coal being within a region not greater than 1400° C. in the four-dimensional state diagram for $SiO_2$—CaO—MgO-20% $Al_2O_3$, and being above a second boundary line according to equation (2) representing a relationship between the $SiO_2$ content x and the CaO content y; and the MgO is selected as the additive upon the ash melting point of the mixed coal being within a region not greater than 1400° C. in the four-dimensional state diagram for $SiO_2$—CaO—MgO-20% $Al_2O_3$, and being above the first boundary line and below the second boundary line:

$$y=0.083x^2-6.67x+166.3 \quad (1)$$

$$y=0.065x^2-6.86x+177.4 \quad (2).$$

* * * * *